US007458359B2

(12) United States Patent
Yoneyama et al.

(10) Patent No.: US 7,458,359 B2
(45) Date of Patent: Dec. 2, 2008

(54) INTERNAL COMBUSTION ENGINE HAVING CRANKCASE WITH STRESS-RELIEVING WALL STRUCTURE

(75) Inventors: Masaki Yoneyama, Saitama (JP); Naoki Kono, Saitama (JP); Kohji Minami, Saitama (JP); Fumiaki Okubo, Saitama (JP); Hiroshi Kuribara, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 83 days.

(21) Appl. No.: 11/711,463

(22) Filed: Feb. 27, 2007

(65) Prior Publication Data

US 2008/0092845 A1 Apr. 24, 2008

(30) Foreign Application Priority Data

Oct. 23, 2006 (JP) ..... 2006-287091

(51) Int. Cl.
*F02B 75/22* (2006.01)

(52) U.S. Cl. ..... 123/195 R

(58) Field of Classification Search ..... 123/195 R, 123/195 H, 195 HC; 92/140; 411/392, 395
See application file for complete search history.

(56) References Cited

U.S. PATENT DOCUMENTS

| | | | | |
|---|---|---|---|---|
| 5,860,404 | A | 1/1999 | Tanaka | |
| 5,931,135 | A | 8/1999 | Yamada | |
| 6,971,362 | B2 * | 12/2005 | Gunji et al. | 123/195 R |
| 2003/0041815 | A1 | 3/2003 | Kawakubo et al. | |
| 2006/0169224 | A1 | 8/2006 | Lenz et al. | |

FOREIGN PATENT DOCUMENTS

| | | |
|---|---|---|
| DE | 4012475 | 10/1990 |
| DE | 19645691 | 5/1998 |
| DE | 19803242 | 8/1998 |
| DE | 19756390 | 6/1999 |
| DE | 19949929 | 1/2001 |
| DE | 10102764 | 7/2002 |
| EP | 1288460 | 3/2003 |
| EP | 1676989 | 7/2006 |
| GB | 187425 | 10/1922 |
| JP | 10-122042 | 5/1998 |

* cited by examiner

*Primary Examiner*—Noah Kamen
(74) *Attorney, Agent, or Firm*—Carrier, Blackman & Associates, P.C.; William D. Blackman; Joseph P. Carrier

(57) ABSTRACT

An internal combustion engine is provided with a crankcase partitioned into an upper section and a lower section. A fastening bolt is provided for fastening the upper and lower crankcase sections together in the vicinity of a crankshaft. A bolt hole is formed in the crankcase, and the fastening bolt is inserted and tightened in the bolt hole. An opening is formed at an end of the bolt hole within the upper crankcase, the end of the bolt hole is made to communicate with this opening, and the end of the fastening bolt protrudes into the opening when the engine is assembled, to lighten the crankcase, and in order to avoid concentrating stress in the bolt hole near the end of the bolt.

20 Claims, 4 Drawing Sheets

PRIOR ART

INTERNAL COMBUSTION ENGINE HAVING CRANKCASE WITH STRESS-RELIEVING WALL STRUCTURE

CROSS-REFERENCE TO RELATED APPLICATIONS

The present invention claims priority under 35 USC 119 based on Japanese patent application No. 2006-287091, filed on Oct. 23, 2006. The subject matter of this priority document is incorporated by reference herein.

BACKGROUND OF THE INVENTION

1. Field of the Invention

The present invention relates to a crankcase of an internal combustion engine, and particularly relates to fastening structure of a part supporting a crankshaft in the crankcase.

2. Background Art

An engine structure, including a crankcase employing a fastening structure for fastening a crankcase and a crank cap in a circumference of a crankshaft is known. The known fastening structure includes providing an opening formed at the end of, and communicating with, a bolt hole which receives the fastening member therein. An engine structure of this type is described, for example, in published Japanese patent document JP-A No. H10-122042.

In a fastened part of a crankshaft wall, which rotatably supports the crankshaft, a load applied to the crankshaft has a great effect upon the fastened part. In the engine structure disclosed in published Japanese patent document JP-A No. H10-122042, the end of a bolt remains inside the crankcase, and stress may build up and become concentrated in the crankcase at a location corresponding to a circumference of the bolt end. Therefore, the rigidity of the crankcase is required to be increased, the weight of the crankcase necessarily increases, and it is difficult to reduce the weight of the crankcase, which affects vehicle weight and fuel economy.

The crankcase described in published Japanese patent document JP-A No. H10-122042 is roughly equivalent to an upper crankcase in the present specification, and the crank cap in published Japanese patent document JP-A No. H10-122042 is roughly equivalent to a lower crankcase in the present specification.

SUMMARY OF THE INVENTION

The present invention addresses the problems encountered in the known art. In a first aspect of the present invention, an internal combustion engine is provided with a crankcase that is partitioned into upper and lower crankcase sections. The engine further includes a crankshaft that is rotatably journalled on the crankcase, a fastening bolt for fastening together upper and lower crankcase sections in a circumference of the crankcase, and a bolt hole which is formed in the crankcase and into which the fastening bolt is inserted and tightened. The first aspect of the invention is characterized in that an opening is formed at an upper end of the bolt hole in the upper crankcase, the end of the bolt hole communicates with the opening, and the end of the fastening bolt protrudes into the opening when the bolt is fastened.

In a second aspect of the present invention, an internal combustion engine is based on the engine according to the first aspect, and is further characterized in that a portion of the crankcase, at a location corresponding to the circumference of the end of the bolt hole, forms a protrusion which protrudes into the opening of the crankcase.

In a third aspect of the present invention, an internal combustion engine is based on the engine according to the second aspect, and is further characterized in that the end of the bolt hole at the protrusion includes an enlarged diameter portion. The enlarged diameter portion has an inside diameter that is longer than a diameter of the bolt hole, and the enlarged diameter portion extends inward from the opening of the crankcase a predetermined distance. In addition, no screw thread is provided on the enlarged diameter portion.

In a fourth aspect of the present invention, an internal combustion engine is based on the engine according to the first aspect through third aspects, and is further characterized in that the opening is formed in an arbitrary anomalous shape, and a V-shaped rib is formed along and edge of the opening. The upper end of the bolt hole opens into the opening at a location corresponding to the center of the V-shaped rib.

In a fifth aspect of the present invention, an internal combustion engine is based on the engine according to the first through fourth aspects, and is further characterized in that a cylinder block in which plural cylinders are arranged in parallel is provided on the open upper surface of the crankcase. The opening is formed in each of plural crank journal walls which partition an internal space of the cylinder block into plural spaces corresponding to the cylinders of the crankcase.

In a sixth aspect of the present invention, an internal combustion engine is based on the engine according to the first aspect, and is further characterized in that the opening is formed in a circle. In addition, the opening is formed so that its diameter is equivalent to the double or less of a diameter of the bolt hole.

According to the first aspect of the invention, since the end of the bolt hole communicates with the opening, and the end of the fastening bolt extends into the opening, a concentration of stress on the side of the bolt hole at the end of the bolt is avoided. Therefore, because stress is dispersed along the whole of the fastened part of the bolt hole, the durability is enhanced and the crankcase can be reduced in weight.

According to the second aspect of the invention, since a portion of the crankcase, at a location corresponding to a the circumference of the end of the bolt hole, protrudes into the opening of the crankcase, stress applied to the crankcase at the end of the bolt hole can be relieved by employment of the protrusion, and the rigidity of the crankcase is more enhanced. In addition a sufficient fastened length of the bolt hole is secured.

According to the third aspect of the invention, the protrusion of the bolt into the opening can be inhibited. In addition, the exposure of the edge of the termination of the bolt hole caused in working a screw can be prevented.

According to the fourth aspect of the invention, the opening can be formed in an arbitrary anomalous shape different from a regular shape such as a circle. As a result, the peripheral shape of the opening can be varied in accordance with the necessity of securing the rigidity of the crankcase, and the opening in the crankcase can be maximally expanded. In addition, the V-shaped rib is arranged along the peripheral edge of the opening, and tensile stress applied to the periphery of the opening from the fastened part is dispersed in the whole crankcase. Thus, a reduction in crankcase weight and sufficient rigidity thereof is achieved.

According to the fifth aspect of the invention, since the opening provided to the crank journal wall functions for pressure relief between cylinders, pumping loss is reduced and friction is also reduced.

According to the sixth aspect of the invention, when the opening is formed in a circular shape, since tensile stress applied to the circular opening is uniformly received in the circumference of the circular part, and since the inside diameter of the opening is set to a length that is double or less the diameter of the bolt hole, the reduction of the rigidity of the crankcase is possibly inhibited and the dispersion of the tensile stress is enabled.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION

A selected illustrative embodiment of the invention will now be described in some detail, with reference to the drawings. It should be understood that only structures considered necessary for clarifying the present invention are described herein. Other conventional structures, and those of ancillary and auxiliary components of the system, are assumed to be known and understood by those skilled in the art.

Figure 1:
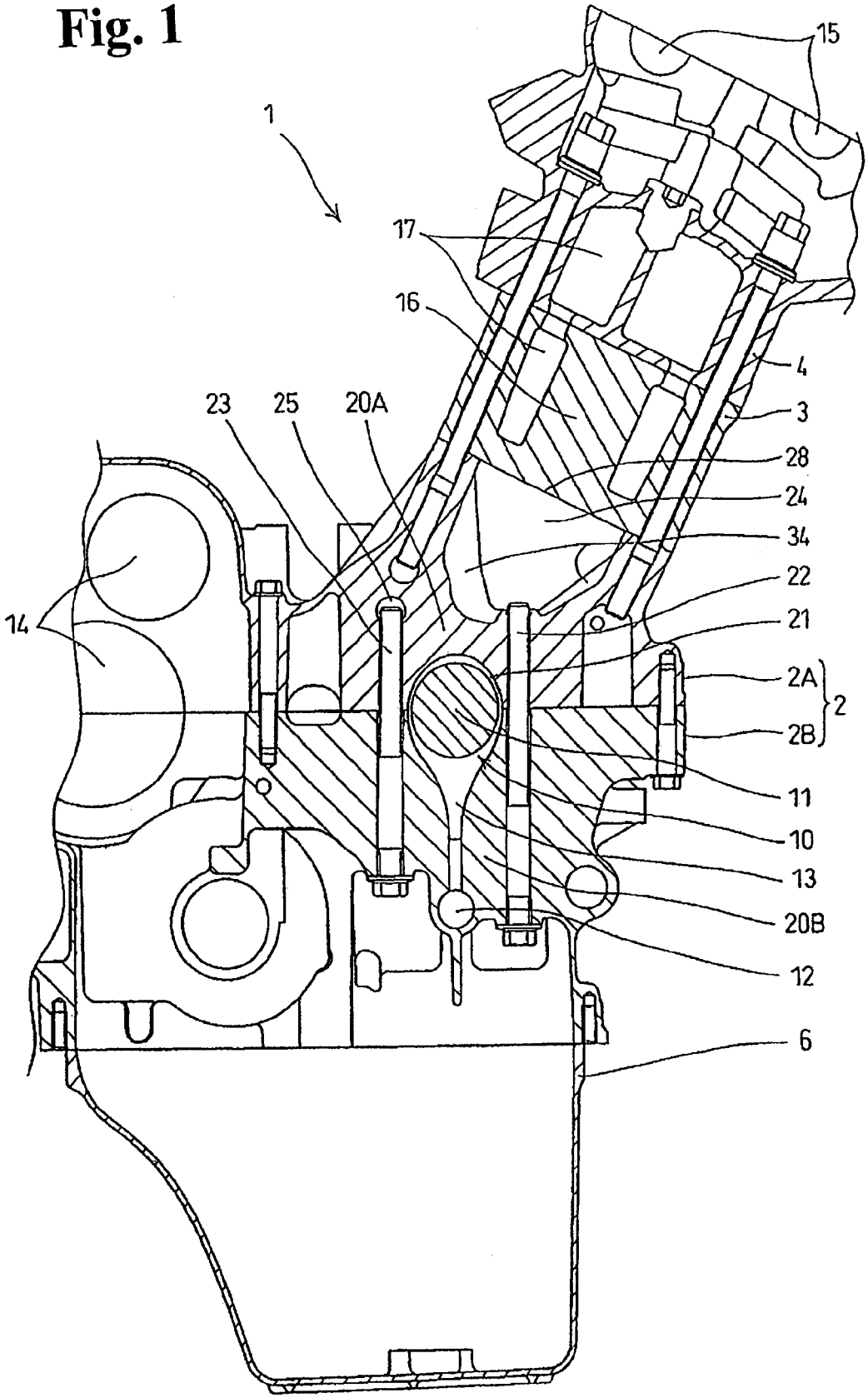
FIG. 1 is a longitudinal sectional view of an internal combustion engine is illustrated showing a section of a bulkhead between cylinders at which the partitioned crankcase is joined by elongate bolts according to one embodiment of the invention.

Referring now to FIG. 1, a longitudinal sectional view of an internal combustion engine is illustrated showing a section of a bulkhead between cylinders at which the partitioned crankcase is joined by elongate bolts according to one embodiment of the invention. The internal combustion engine is, for example, an in-line four-cylinder internal combustion engine. A crankcase 2 is partitioned along a substantially horizontal plane into two vertically stacked portions, and is thus configured by an upper crankcase 2A and a lower crankcase 2B. A cylinder block 3, a cylinder head 4 and a cylinder head cover are connected to the upper side of the upper crankcase 2A. The cylinder head cover is not shown. An oil pan 6 is connected to the bottom of the lower crankcase 2B.

A crankshaft supporting part 10 is formed on joined faces of the upper crankcase 2A and the lower crankcase 2B, and a crankshaft 11 is rotatably supported in this part. A main gallery 12 and a lubricating oil passage 13 are provided under the crankshaft supporting part 10. A transmission shaft supporting structure 14 is provided to the rear of the crankcase 2, and a camshaft supporting part 15 for driving an intake/exhaust valve is provided on an upper part of the cylinder head 4. A water jacket 17 is provided within inner circumferences of the cylinder block 3 and the cylinder head 4 and the cylinder bulkhead 16.

An upper crank journal wall 20A and a lower crank journal wall 20B are provided on the upper and lower crankcases 2A, 2B, respectively, and are parts that correspond to a crank journal portion of the cylinder bulkhead 16. A journal bearing 21 is provided to the crankshaft supporting part 10 formed in the crank journal walls 20A, 20B. The upper crankcase 2A and the lower crankcase 2B are fastened together by plural fastening bolts. The front of the crankshaft supporting part 10 is fastened by a front fastening bolt 22, and the rear of the crankshaft supporting part is fastened by a rear fastening bolt 23, the respective fastening bolts 22, 23 being particularly long.

In this embodiment, a large opening 24 having an anomalous, or irregular, peripheral shape is provided in the crank journal wall 20A of the upper crankcase 2A. The opening communicates with spaces corresponding to adjacent cylinders. The opening is provided with the anomalous shape because it does not have a circular shape formed by normal machining but is formed in an arbitrary shape if necessary. A small circular opening 25, having a circular section and extending through the plural crank journal walls 20A, is located rearward of the large anomalous outline opening 24 of the crank journal wall 20A of the upper crankcase 2A, and extends in parallel with the crankshaft 11. The small circular opening 25 is formed by drilling or other means.

Figure 2:
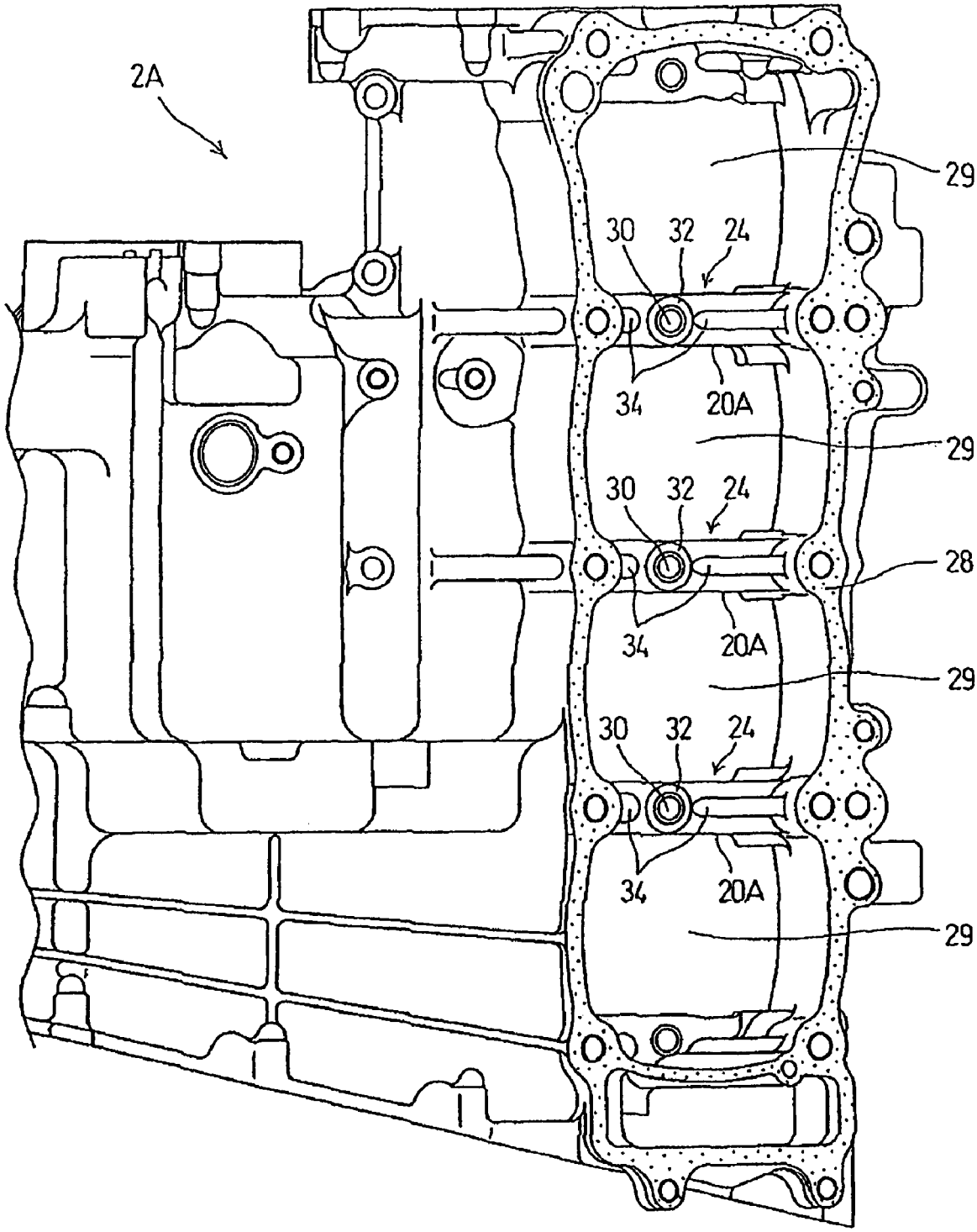
FIG. 2 is a top plan view of the internal combustion engine of FIG. 1 showing an upper face of the upper crankcase, which corresponds to the face along which the crankcase is joined to the cylinder block.

FIG. 2 is a top view showing a main part of the upper crankcase 2A. In FIG. 2, an upper face 28 of the upper crankcase 2A is shown which corresponds to the face along which the crankcase is joined to the cylinder block 3. As described above, the internal combustion engine is a four-cylinder internal combustion engine, and plural crank journal walls 20A are provided in the upper crankcase 2A which partition the interior of the crankcase into spaces 29 corresponding to respective cylinders. As seen in FIG. 2, the large opening 24 is provided in a crank journal wall 20A. In addition, a front bolt hole 30 into which the front fastening bolt 22 is fitted (bolt 22 is not shown in FIG. 2 such that the bolt hole 30 is vacant) and a rib 34 are provided on an edge of the large opening 24.

Figure 3:
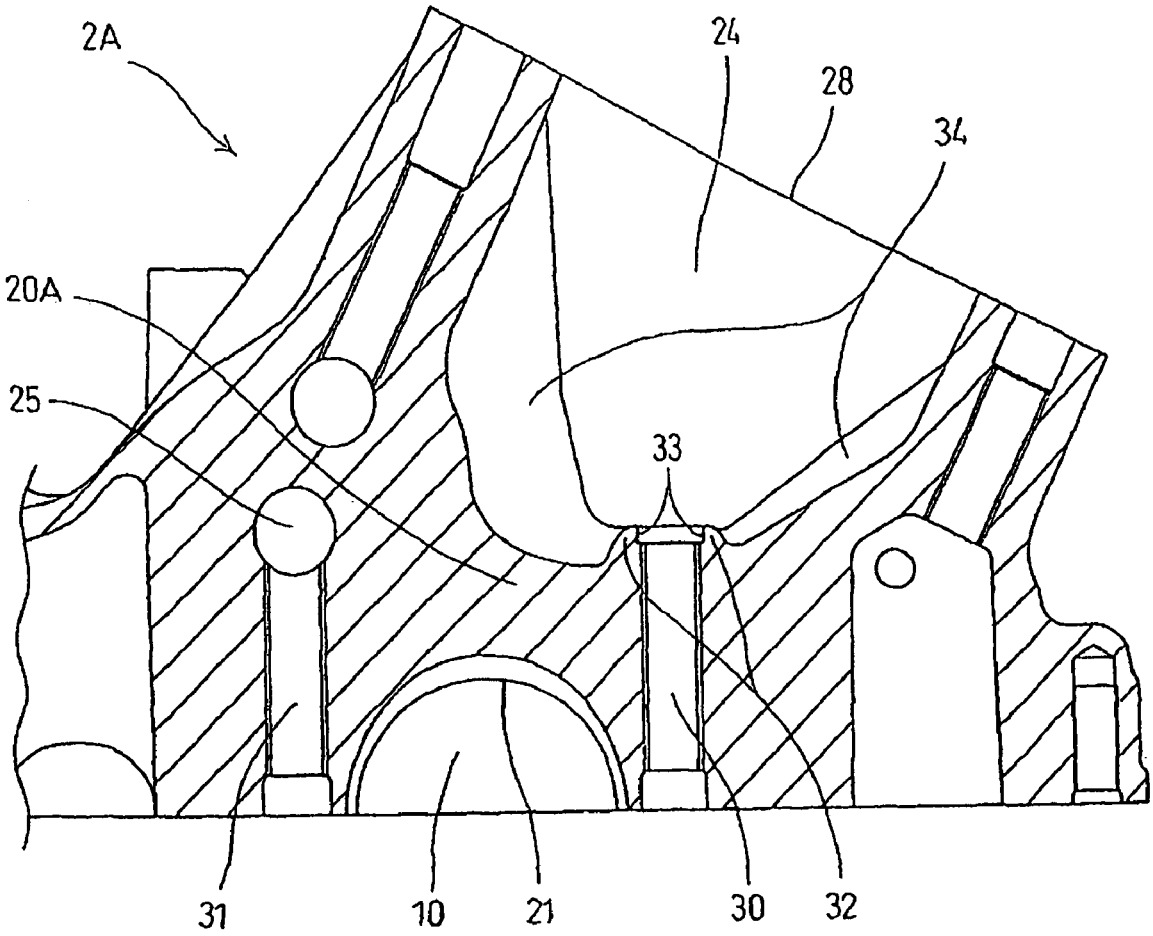
FIG. 3 is an enlarged longitudinal sectional view of an upper portion of the crankcase showing openings formed therein.

FIG. 3 is an enlarged longitudinal section showing a main part of the upper crankcase 2A and shows the circumference of bolt holes 30, 31 in front of and rearward of the crankshaft supporting part 10 provided to the upper crank journal wall 20A. The front bolt hole 30 is a bolt hole into which the front fastening bolt 22 is screwed and the rear bolt hole 31 is a bolt hole into which the rear fastening bolt 23 is screwed. An upper end of the front bolt hole 30 opens to, and communicates with, the large opening 24. A portion of the upper crank journal wall 20A corresponding to the circumference of the upper end of the front bolt hole 30 protrudes into the large opening 24. This portion of the upper crank journal wall 20, forming a bolt hole end circumference protruded part, will be referred to as protrusion 32. In the protrusion 32, the bolt hole 30 is provided with an enlarged diameter part 33, the inside diameter of which is slightly enlarged compared with the diameter of the bolt hole. The enlarged diameter part 33 is formed to extend inward from the end (that is, from the intersection of the enlarged diameter part 33 with the large opening 24) by predetermined distance, and no screw thread is formed within the enlarged diameter part 33. A V-shaped rib 34 is formed along the edge of the large opening 24, and the upper end of the front bolt hole 30 is located in the center (at the apex) of the rib 34. The distal end of the front fastening bolt 22, when fitted into the front bolt hole 30, protrudes into the large opening 24 as shown in FIG. 1.

As described above, the small circular opening 25 is formed having a circular section, and is formed in the crank journal wall 20A of the upper crankcase 2A by drilling or other methods. The end of the rear bolt hole 31 is open to, and communicates with, the small circular opening 25. The end of the rear fastening bolt 23, when screwed into the rear bolt hole 31, protrudes into the small circular opening 25 as shown in FIG. 1. Optimally, the inside diameter of the small circular opening has length equivalent to 1.3 times that of the inside diameter of the corresponding bolt hole. However, it is desirable that the inside diameter of the small circular opening has a length that, at the maximum, is double or less than that of the inside diameter of the corresponding bolt hole. In particular, an upper limit of the dimension of the inside diameter of the small circular opening is set to avoid deterioration of the rigidity of the crankcase.

Figure 4A:
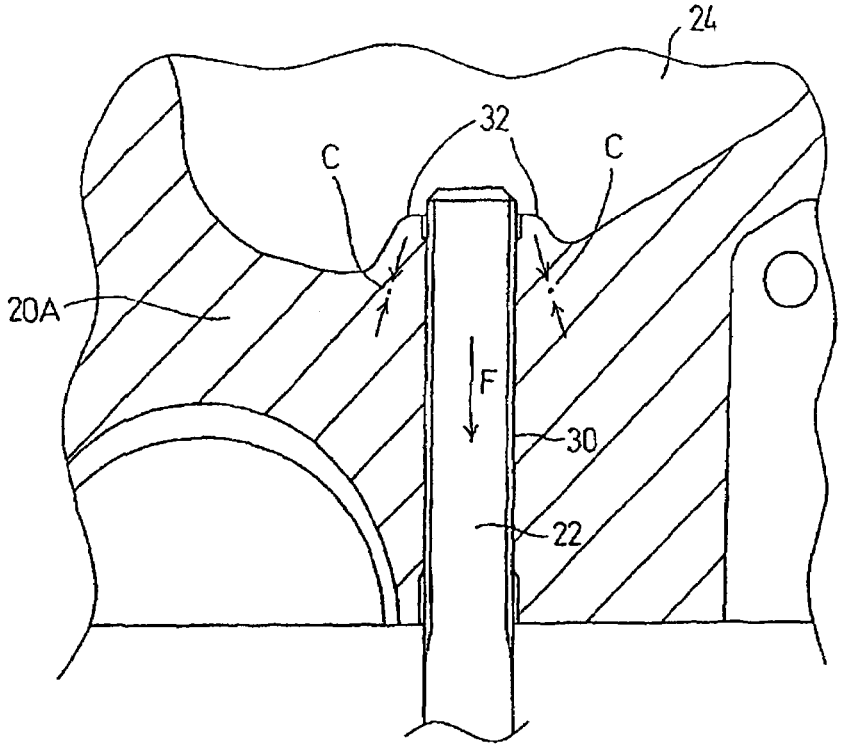
FIG. 4A is an enlarged view of the upper end of the front bolt hole 30 showing the front bolt in place within the bolt hole, and is a first explanatory drawing for explaining the effect of employing a bolt hole end circumference protrusion.
Figure 4B:
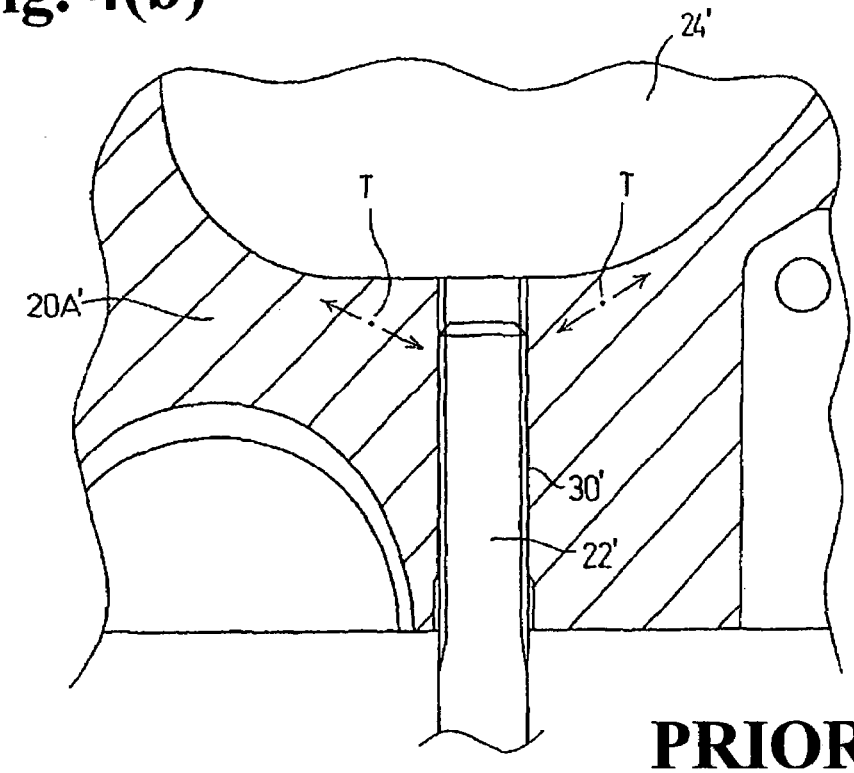
FIG. 4B is an enlarged detail view of the upper end of a bolt hole in a conventional prior art crankcase, in which no protrusion is formed in a circumference of the end of the bolt hole, and is a second explanatory drawing for explaining the effect of not employing a bolt hole end circumference protrusion.

FIGS. 4A and 4B are explanatory drawings for explaining the effect of the protrusion 32 in the invention. FIG. 4(*a*) shows an enlarged view of the upper end of the bolt hole 30. In that part in the invention, the protrusion 32 is formed in the crank journal wall 20A at a location corresponding to the circumference of the end of the bolt hole 30, and when the crankcase is assembled, the end of the fastening bolt 22 protrudes into the large opening 24. FIG. 4(*b*) shows the an enlarged view of the upper end of a bolt hole 30' in a conventional crankcase in which no protrusion is formed in a crank journal wall 20A' at a location corresponding to a circumference of the end of the bolt hole 30', and the end of a fastening bolt 22' is present in the bolt hole 30'. As shown in FIG. 4(*b*), when no protrusion is formed in the circumference of the end of the bolt hole 30', a tensile stress T is generated in the crank journal wall 20A' in the vicinity of the fastening bolt 22' in the assembled internal combustion engine.

In contrast, as shown in FIG. 4(*a*), when the protrusion 32 is formed in the crank journal wall 20A at a location corresponding to the circumference of the end of the bolt hole 30, a compressive stress is generated in the crank journal wall 20A in the vicinity of the fastening bolt in the assembled internal combustion engine. Moreover, it is generally known that the fatigue strength of structure is enhanced by compressive stress.

Further, since a tensile force F acts on the fastening bolt 22 resulting from the vibration of the crankshaft when the internal combustion engine is driven, a larger compressive stress is produced in the vicinity of the bolt hole in the crank journal wall 20A when the protrusion 32 is formed thereon, and the fatigue strength of the crank journal wall 20A is increased.

As described in detail above, since this embodiment has the above-mentioned configuration, the following effect is produced.

Generally, when the end of the fastening bolt remains within the bolt hole, the concentration of stress is generated in the crankcase wall at a location corresponding to the circumference of the bolt hole at a boundary between a part of the bolt hole in which the fastening bolt is fitted and a part of the bolt hole in which the fastening bolt is not fitted. In this embodiment, since the ends of the bolt holes 30, 31 are made to communicate with the openings 24, 25 formed in the crank journal wall 20A, and the ends of the fastening bolts 22, 23 protrude into the respective openings, the concentration of stress in the circumferences of the bolt holes 30, 31 at the ends of the bolts is avoided. Therefore, since the stress is dispersed along the whole of the fastened parts of the bolt holes, the durability is enhanced and the crankcase can be reduced in weight.

Since the crank journal wall 20A, at a location corresponding to the circumference of the end of the bolt hole 30, protrudes into the large opening 24 in the crank journal wall 20A, stress applied to the end of the bolt hole 30 is relieved by the protrusion 32 and the rigidity of the crankcase is more enhanced. In addition, a sufficient fastened length of the bolt hole 30 is secured.

In the protrusion 32, since the enlarged diameter part 33, the inside diameter of which is longer than the diameter of the bolt hole, extends from the upper end of the bolt hole 30 to the inside thereof by the predetermined distance, and since no screw thread is formed within the enlarged diameter part, the protrusion of the bolt 22 into the opening 24 in the crank journal wall 20A can be inhibited. In addition, the exposure of the acute-angled edge of the termination of the bolt hole caused in working a screw can be prevented.

The large opening 24 in the crank journal wall 20A is not necessarily required to have a regular shape such as a round shape, but instead can be formed in an arbitrary anomalous or irregular shape. As a result, the shape can be varied in accordance with the necessity of securing the rigidity of the crankcase, and the opening in the crank journal wall can be maximally expanded. In addition, the V-shaped rib 34 is arranged along the peripheral edge of the opening, and the end of the bolt hole is located in the center of the rib 34. As a result, tensile stress applied to the opening from the fastened part can be dispersed in the whole crankcase, and weight-reduction and securing the rigidity of the crankcase is achieved.

Since the openings 24, 25 provided to the crank journal wall function for pressure relief between cylinders, pumping loss is reduced and friction is also reduced.

When the circular opening 25 is provided in the crank journal wall, tensile stress applied to the opening can be uniformly received in the circumference of the circular part. Moreover, since the inside diameter of the opening is set to the double or less the diameter of the corresponding bolt hole, the reduction of the rigidity of the crankcase is possibly inhibited, and the dispersion of the tensile stress is enabled.

Although the present invention has been described herein with respect to a number of specific illustrative embodiments, the foregoing description is intended to illustrate, rather than to limit the invention. Those skilled in the art will realize that many modifications of the preferred embodiment could be made which would be operable.

For example, in the above-mentioned embodiment, the opening is provided in the crank journal wall, however, a position of the opening is not limited to the crank journal wall. Al such modifications, which are within the scope of the claims, are intended to be within the scope and spirit of the present invention.

What is claimed is:

1. An internal combustion engine, comprising:

a crankcase partitioned into an upper section and a lower section;

a crankshaft rotatably supported between the upper and lower sections of the crankcase; and a fastening bolt that fastens the upper and lower sections together, wherein the crankcase has a bolt hole formed therein in an area of the crankcase proximate the crankshaft, into which the fastening bolt is inserted and tightened, the upper section has an opening formed therein at an upper end of the bolt hole, wherein the opening extends laterally and outwardly on sides of the bolt hole and expands towards an upper face of the upper section;

the upper end of the bolt hole communicates with the opening, and when the fastening bolt is fastened, an end of the fastening bolt protrudes into the opening.

2. The internal combustion engine according to claim 1, wherein a protrusion, corresponding to a portion of the upper section at a circumference of the upper end of the bolt hole, protrudes into the opening.

3. The internal combustion engine according to claim 2, wherein the upper end of the bolt hole at the protrusion comprises an enlarged diameter portion, the enlarged diameter portion having an inside diameter that is greater than a diameter of the bolt hole; and a substantially smooth inner surface which is without screw threads, wherein the enlarged diameter portion extends inward a predetermined distance from the opening.

4. The internal combustion engine according to claim 1, wherein the internal combustion engine further comprises a plurality of cylinders arranged in parallel, and the upper section comprises:

a cylinder block which includes the plurality of cylinders, and plural crank journal walls partitioning an internal space of the cylinder block into cylinder spaces, wherein the opening is formed in at least one crank journal wall.

5. The internal combustion engine according to claim 4, wherein the opening permits communication between adjacent cylinder spaces.

6. The internal combustion engine according to claim 1, wherein the upper section has a rear bolt hole and a substantially circular opening formed therein;

wherein the substantially circular opening has a diameter less than or equal to two times a diameter of the rear bolt hole; and wherein said rear bolt hole extends below the circular opening.

7. The internal engine according to claim 6, wherein the rear bolt hole is disposed between the crankshaft and a rear side of the crankcase.

8. The internal engine according to claim 1, wherein the bolt hole is disposed between the crankshaft and a front side of the crankcase.

9. An internal combustion engine, comprising:

a crankcase partitioned into an upper section and a lower section;

a crankshaft rotatably supported between the upper and lower sections of the crankcase; and a fastening bolt that fastens the upper and lower sections together, wherein the crankcase has a bolt hole formed therein in an area of the crankcase proximate the crankshaft, into which the fastening bolt is inserted and tightened, the upper section has an opening formed therein at an upper end of the bolt hole, the upper end of the bolt hole communicates with the opening, and when the fastening bolt is fastened, an end of the fastening bolt protrudes into the opening;

wherein the opening is formed in an arbitrary anomalous shape, a V-shaped rib is formed along an edge of the opening, and the upper end of the bolt hole is disposed in the center of the V-shaped rib.

10. An internal combustion engine, comprising:

a crankcase partitioned into an upper section and a lower section;

a crankshaft rotatably supported between the upper and lower sections of the crankcase; and fastening bolts that fasten the upper and lower sections together, wherein the crankcase has a first bolt hole formed in the crankcase between the crankshaft and a front side of the crankcase, into which a first fastening bolt is inserted and tightened, the crankcase has a second bolt hole formed in the crankcase between the crankshaft and a rear side of the crankcase, into which a second fastening bolt is inserted and tightened, the upper section has a first opening formed therein at an upper end of the first bolt hole, and the upper end of the first bolt hole communicates with the first opening, the upper section has a second opening formed therein at an upper end of the second bolt hole, and the upper end of the second bolt hole communicates with the second opening, and when the first and second fastening bolts are fastened in their respective bolt holes, an end of the fastening bolts protrude into the respective opening; and wherein the first opening extends laterally and outwardly on sides of the first bolt hole and expands towards an upper face of the upper section.

11. The internal combustion engine according to claim 10, wherein a protrusion, corresponding to a portion of the upper section at a circumference of the upper end of the first bolt hole, protrudes into the first opening.

12. The internal combustion engine according to claim 11, wherein the upper end of the first bolt hole at the protrusion comprises an enlarged diameter portion, the enlarged diameter portion having an inside diameter that is greater than a diameter of the first bolt hole; and a substantially smooth inner surface which is without screw threads, the enlarged diameter portion extending inward a predetermined distance from the first opening.

13. The internal combustion engine according to claim 10, wherein the first opening is formed in an arbitrary anomalous shape, a V-shaped rib is formed along an edge of the first opening, and the upper end of the first bolt hole is disposed in the center of the V-shaped rib.

14. The internal combustion engine according to claim 10, wherein the internal combustion engine further comprises a plurality of cylinders arranged in parallel, and the upper section comprises:

a cylinder block which includes the plurality of cylinders, and plural crank journal walls partitioning an internal space of the cylinder block into cylinder spaces, wherein the first opening is formed in at least one crank journal wall.

15. The internal combustion engine according to claim 10, wherein the second opening is formed having a circular shape, and the second opening has a diameter which is less than or equal to two times a diameter of the second bolt hole.

16. The internal combustion engine according to claim 10, wherein the size of the second opening is small relative to the size of the first opening.

17. An internal combustion engine, comprising:

a crankcase partitioned into an upper section and a lower section; said crankcase having a bolt hole formed therein;

a fastening bolt disposed in said bolt hole; said fastening bolt fastening the upper and lower sections of the crankcase together;

a protrusion formed in the upper section; said protrusion having a portion of the bolt hole formed therein; and said upper section of the crankcase having an anomalous shaped opening formed therein; wherein said opening communicates with an upper end of the bolt hole via said portion of the bolt hole formed in the protrusion.

18. The internal combustion engine according to claim 17, wherein a diameter of said portion of the bolt hole is greater than a diameter of the bolt hole.

19. The internal combustion engine according to claim 17, wherein said portion of the bolt hole has a substantially smooth inner surface.

20. The internal combustion engine according to claim 17, wherein said upper section has a rear bolt hole, and a circular opening connected to the rear bolt hole formed therein; and wherein a diameter of the rear bolt hole is less than a diameter of the circular opening.

* * * * *